US005316194A

United States Patent [19]

Sarraf

[11] Patent Number: 5,316,194

[45] Date of Patent: May 31, 1994

[54] FLUID DISPENSING APPARATUS

[76] Inventor: Nabil G. Sarraf, 33 Princes Gate Court, Exhibition Road, London SW7, England

[21] Appl. No.: 901,169

[22] Filed: Jun. 19, 1992

[30] Foreign Application Priority Data

Nov. 15, 1991 [GB] United Kingdom ..... 9124258.6

[51] Int. Cl.[5] ..... G07F 15/04

[52] U.S. Cl. ..... 222/136; 222/129

[58] Field of Search ..... 222/136, 129, 394, 387, 222/351, 396, 397, 399

[56] References Cited

U.S. PATENT DOCUMENTS 3,896,972 7/1975 Neidore et al. ..... 222/136
4,527,713 7/1985 Ingram ..... 222/136
4,751,994 6/1988 Brown, Jr. et al. ..... 222/136
5,145,092 9/1992 Shannon ..... 222/394
5,158,210 10/1992 Du ..... 222/136

*Primary Examiner*—David M. Mitchell
*Assistant Examiner*—Stephen P. Avila
*Attorney, Agent, or Firm*—Jacobson, Price, Holman & Stern

[57] ABSTRACT

Fluid dispensing apparatus comprising:

(a) an atomizer unit (11) for fluid to be dispensed, (b) a non-pressurized remote reservoir (15) for the fluid, and (c) a fluid path, including a flexible conduit (13), between the atomizer unit (11) and the remote reservoir (15) to permit dispensing of non-gas-pressurized fluid in atomised form across a variety of locations remote from said reservoir (15).

16 Claims, 6 Drawing Sheets

FLUID DISPENSING APPARATUS

BACKGROUND TO THE INVENTION

This invention relates to fluid dispensing apparatus.

It has long been known to provide fluid dispensing apparatus comprising an atomiser unit mounted on a container to dispense fluid in atomised form from the container, the container holding all of the fluid to be dispensed and being wholly portable and unattached. However, there is a physical size limitation upon the container to ensure ease of portability, and thus the cost of the atomiser unit is a significant proportion of the overall apparatus cost. Furthermore, where the portable apparatus is for public use, e.g. in public wash rooms and the like, it is readily susceptible to unauthorised removal from its use location.

It is considered desirable to provide fluid dispensing apparatus which can minimise or overcome the above-mentioned and/or other drawbacks of the prior art.

BRIEF DESCRIPTION OF THE INVENTION

According to one aspect of this invention there is provided fluid dispensing apparatus comprising:

(a) an atomiser unit for fluid to be dispensed, (b) a non-pressurised remote reservoir for the fluid, and (c) a fluid path, including a flexible conduit, between the atomiser unit and the remote reservoir to permit dispensing of non-gas-pressurised fluid in atomised form across a variety of locations remote from said reservoir.

According to another aspect of this inventioon there is provided fluid dispensing apparatus comprising an atomiser unit associated with a container for fluid to be dispensed therefrom, a remote reservoir for said fluid, and a flexible conduit connecting the reservoir and the container.

It will be appreciated that, in use, the remote reservoir - which may have a capacity substantially greater (e.g. 10 to 20 times greater) than that of the container - may be fixed in position thereby to hinder theft of the apparatus or at least of the reservoir and its contents (e.g. an expensive perfume, eau de toilette, eau de cologne or the like). Nevertheless the flexible conduit permits the container and its associated atomiser unit to be manoeuvred to a distal use location (e.g. on the body) to which the atomiser fluid is to be directed.

Advantageously a non-return valve is provided in the fluid path between the reservoir and the container to restrict fluid flow from the container to the reservoir. Preferably the non-return valve is located in said flexible conduit.

In one exemplary arrangement, a single reservoir may be connected via a plurality of flexible conduits to a plurality of containers and associated atomising units. With such an arrangement, several individuals can dispense fluid simultaneously. One example would be administration of a sun-tanning oil and/or a UV protective lotion by several persons, e.g. beside a swimming pool or beach area.

In another exemplary arrangement, there is provided a plurality of separate fluid dispensing apparatus (each according to the invention), and a housing is provided to house the plurality of reservoirs. Preferably each such reservoir contains a different fluid such that, even with the housing mounted in a fixed location, any one of the individual atomising units can be selected and individually manoeuvred to dispense a selected fluid in atomised form to its desired (body) location.

BRIEF DESCRIPTION OF THE DRAWINGS

By way of example one embodiment of this invention will now be described with reference to the accompanying drawings of which.

DESCRIPTION OF EMBODIMENTS OF THE INVENTION

Figure 1:
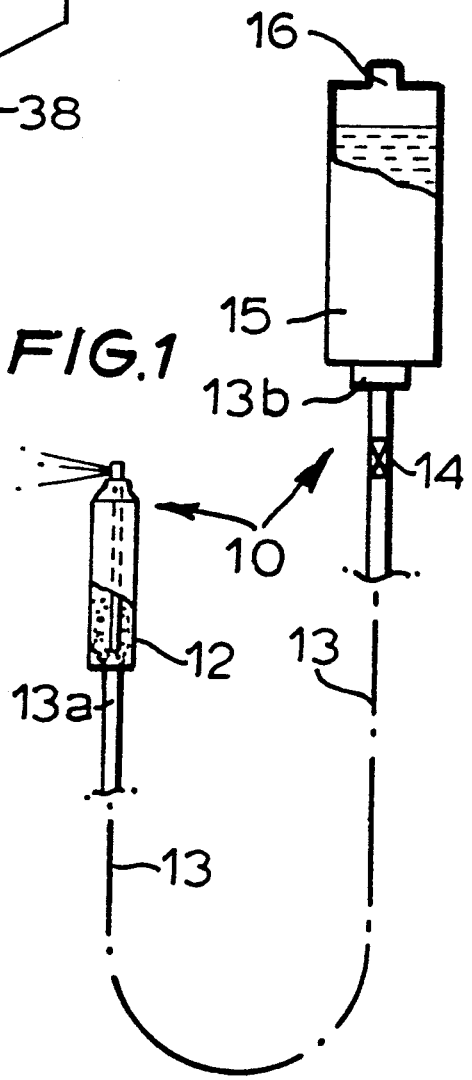
FIG. 1 is a schematic view of fluid dispensing apparatus according to one embodiment of the invention.

The fluid dispensing apparatus 10 illustrated in FIG. 1 comprises a pressure-operable atomiser unit 11 associated with a container 12 that is connected at its base (or a side wall location remote from the atomiser unit 11), to one end 13*a* of a flexible tube 13. The other end 13*b* of the flexible tube 13 is connected to the base of a reservoir 15 provided at its upper end with a removable closure member 16, e.g. a screw-on cap. Alternatively the other end 13*b* of tube 13 may be connected to a side wall location of reservoir 15 at a location remote from its top closure member 16. A non-return valve 14 is provided in the reservoir's outlet to tube 13 or, as shown, in the tube 13 adjacent tube end 13*b*.

The capacity of the reservoir 15 is substantially greater, e.g. 10 to 20 times greater, than the capacity of the container 12. Likewise, the length of the flexible tubing 13 is substantially greater than the axial length of the container 12 (and usually also of the reservoir 15). In one preferred arrangement, the reservoir 15 may have a capacity of 500 ml, the flexible tubing 13 may be 1.5 m long and have an internal diameter of 3 mm, and the container 12 may have a length of 125 mm and an outer diameter of 25 mm.

The atomising unit 11 of this embodiment is essentially a pre-compression pump (e.g. such as that obtainable in the UK from Perfect Valois Limited) that is screw mounted or otherwise attached to the top of the container 12. The atomising unit 11 (see FIG. 2) comprises an external operating button and dispensing head combination 20 mounted on a hollow stem 28 that depends into a cylindrical dosage chamber 21 located within the container 12. The hollow stem 28 has a lateral orifice 29 which, at rest, is covered by a piston member 30 mounted slidably in the dosage chamber 21. The dosage chamber 21 receives fluid from container 12 via an inlet tube 19 and a clapper or float valve 26. High rate and low rate springs 31,32 above and below the piston member 30 serve to urge the stem 28 outwardly of the chamber 21 and container 11.

Figure 2A:
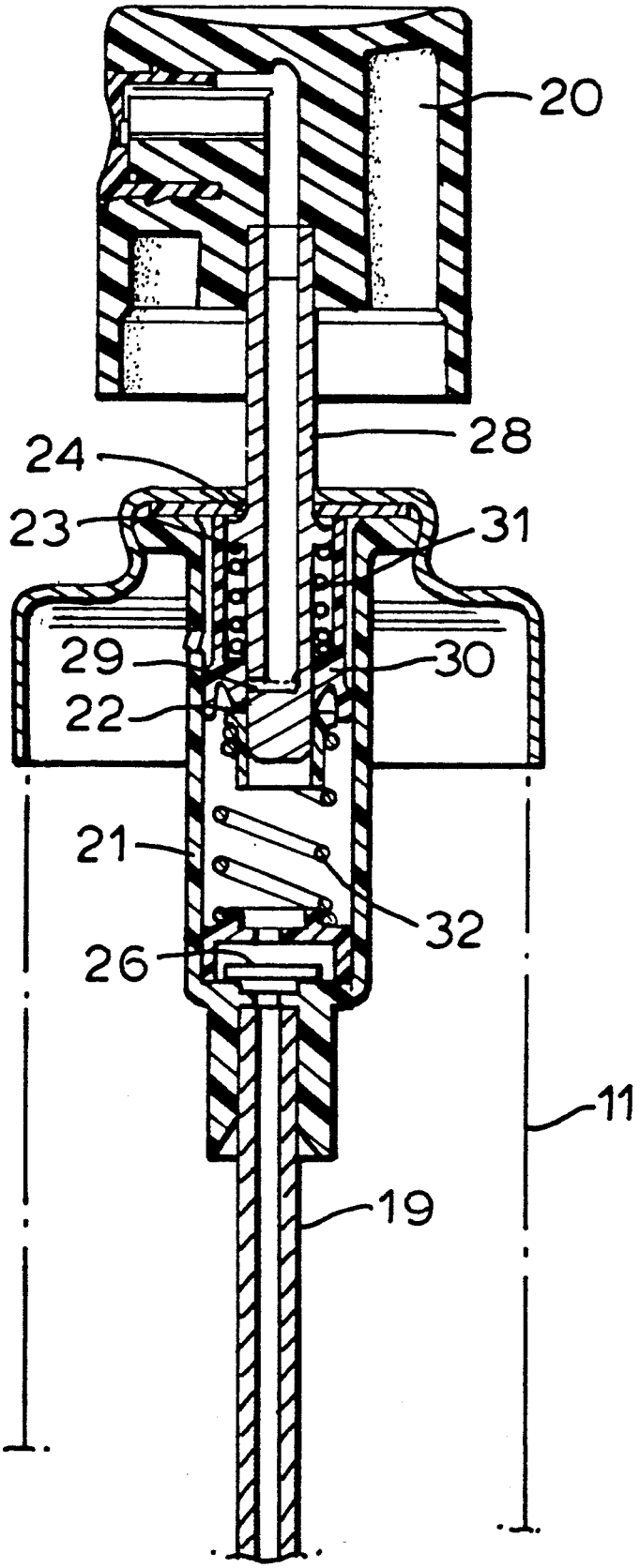
FIG. 2 shows at 2A to 2E cross-sectional views of an atomiser unit in the embodiment of FIG. 1.
Figure 2B:
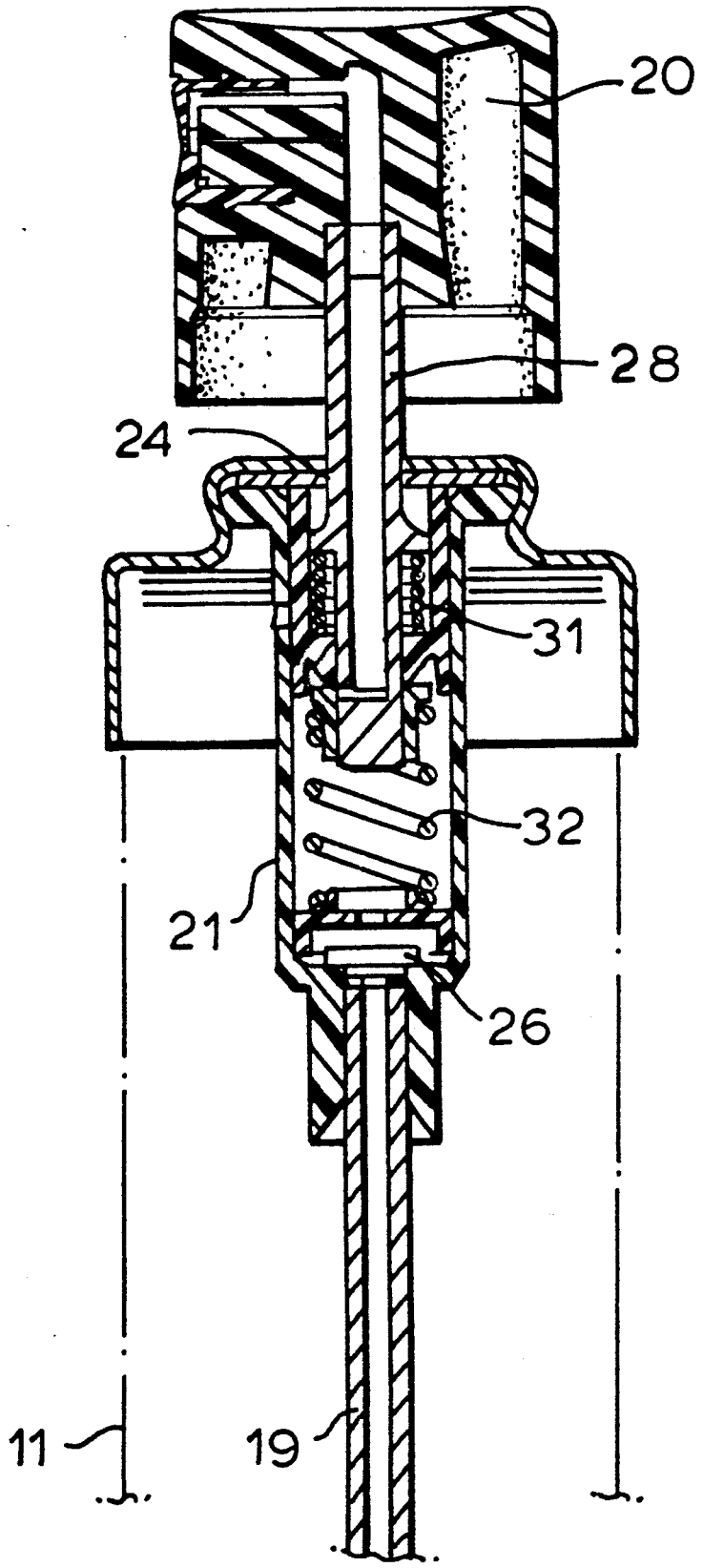

Initially (FIG. 2A), the dosage chamber 21 is filled with liquid, e.g. by actuating the operating button/dispensing head combination 20 two or three times to effect priming. When thus primed, and out of use, the pump is sealed at the interfaces 22,23 between hollow stem 28 and piston member 30 at locations below and above the lateral orifice 29 (whereby the latter is closed), and is also sealed at 24 where the top of the piston member 30 engages the underside of a cap seal for the container 12. Finger pressure on head 20 causes the clapper or float valve 26 to engage its base and seal off the chamber 21 from its inlet tube 19 (FIG. 2B).

Figure 2C:
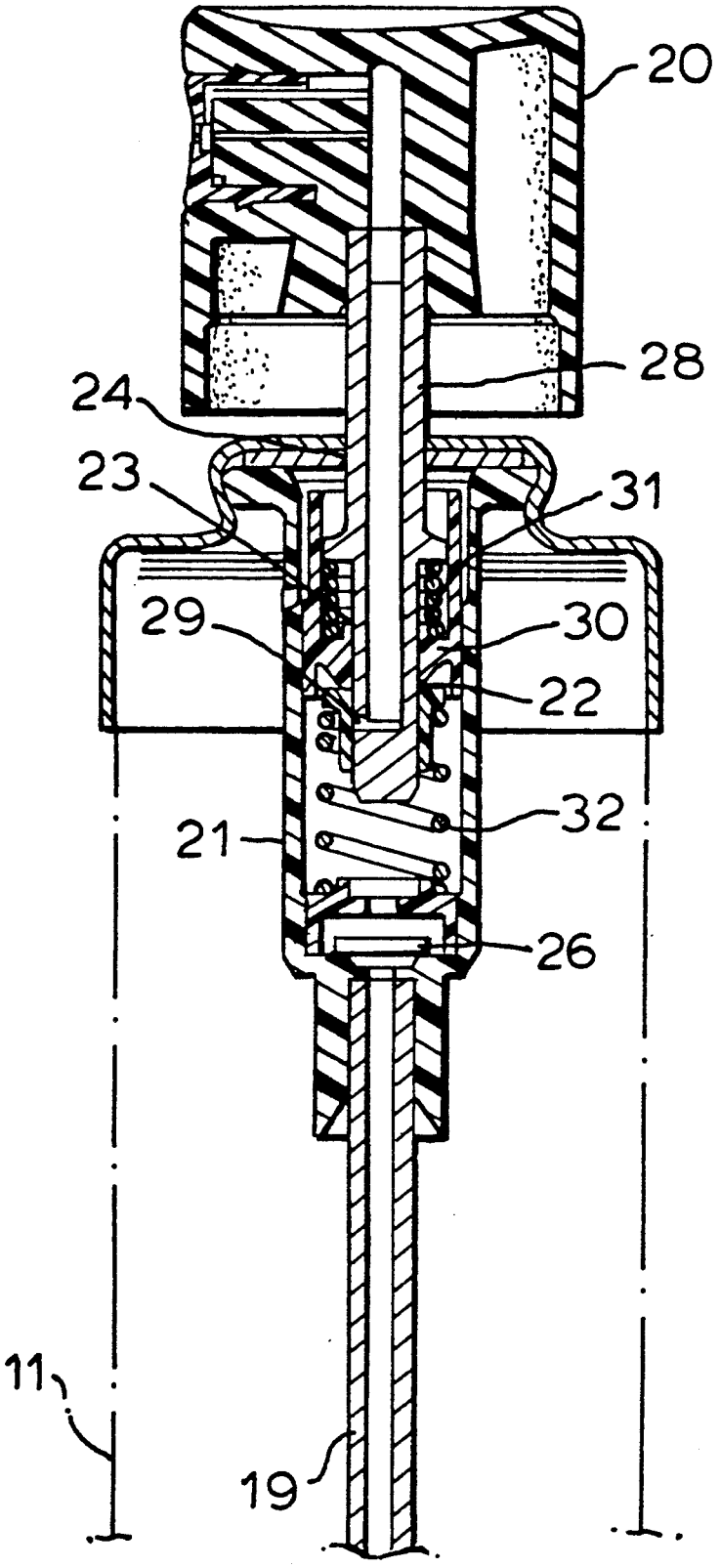
Figure 2D:
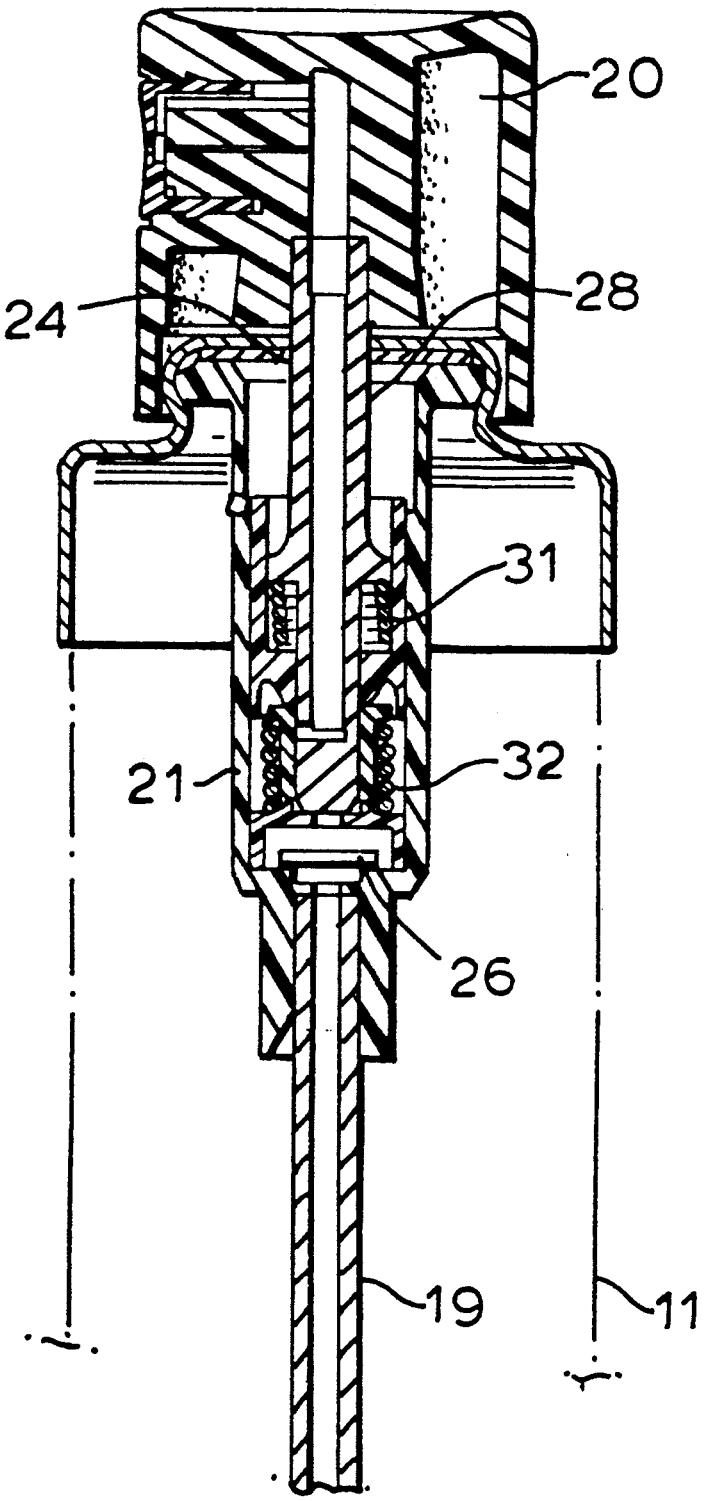
Figure 2E:
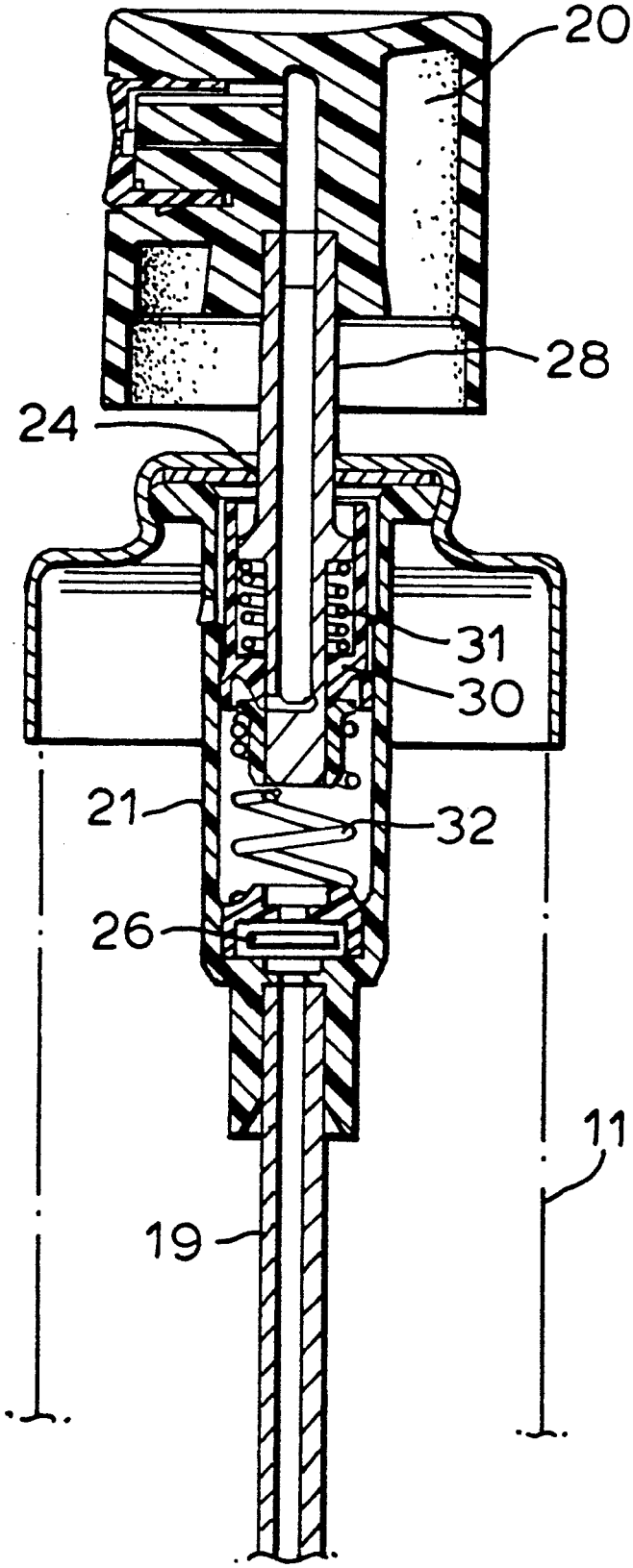

Since the fluid is substantially incompressible, the piston 30 is restrained against downward movement. However, further depression of head 20 causes hollow stem 28 to descend further (compressing spring 31) until its lateral orifice 29 is disengaged from (i.e. is no longer covered by) the piston 30, but is instead open to the now pressurised fluid in the dosage chamber 21 (FIG. 2C). The fluid is therefore ejected up through the hollow stem 28 and into the head 20 to be emitted therefrom as an atomised vapour or spray. FIG. 2D illustrates the position when spraying is completed and further head depression is prevented by the latter's engagement of the container 12 and/or by the stem 28 engaging a cover/retainer of valve 6. Upon release of finger pressure upon the head 20, the springs 31,32 return the piston and the head 20 to their original positions. In doing so, they again effect isolation of the stem's lateral orifice 29 from the dosage chamber 21 and, by a vacuum effect, raise the clapper or float valve 26 to draw in a fresh charge of fluid from the container 12 into the dosage chamber 21 via the inlet tube 19 (FIG. 2E). All the movable parts are thus returned to their initial position.

It will be appreciated that, during its operation, the atomising unit 11 may be moved about and manoeuvred to direct the atomised spray emanating therefrom to any desired body (or other) location. Nevertheless, due to the non-return valve 14, fluid from the container 12 cannot flow out therefrom, in reverse direction, through the flexible tube 13 and back to the positionally fixed reservoir 15—and this applies even if the container 12 is raised about the level of the reservoir 15.

Figure 3:
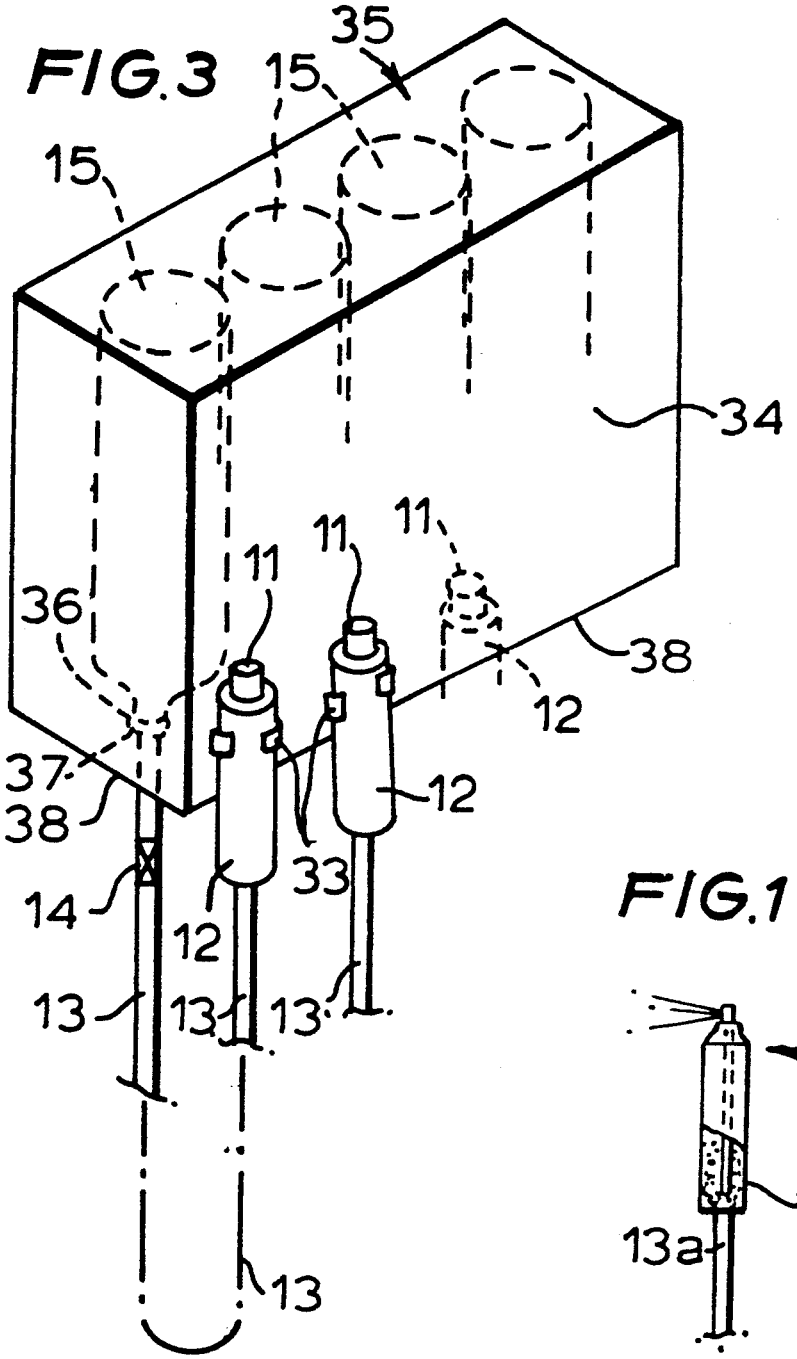
FIG. 3 is a schematic perspective view of fluid dispensing apparatus according to another embodiment of this invention.

In the embodiment illustrated schematically in FIG. 3, a cabinet or like casing 35 to be mounted at a fixed location has a front wall 34 in the form of a panel hinged to one of the other cabinet walls and key-lockable thereto. The cabinet houses a plurality, e.g. four, individual reservoirs 15 each containing a different fluid to be dispensed. The reservoirs 15 are in the form of inverted bottles having their threaded necks 36 protruding through apertures 37 in the bottom wall 38 of cabinet 35. A corresponding number of containers 12—with associated atomising units 11 (e.g. such as those described above with reference to FIGS. 2A to 2E) are mounted in resilient C-clips 33 that are attached to the front wall 34 of the cabinet 35. A corresponding number of flexible tubes 13, each with a non-return valve 14, connect the reservoirs 15 to their associated containers 12. In use, any one of the individual atomising units 11 can be selected and individually manoeuvred to dispense a selected fluid in atomised form to its desired (body) location.

In an alternative arrangement, a single reservoir 15 may be connected via a plurality of flexible conduits 13 to a plurality of containers 12 and associated atomising units 11. With such an arrangement, several individuals can dispense the same fluid simultaneously. One example would be administration of a sun-tanning oil and/or a UV protective lotion by several persons, e.g. beside a swimming pool or beach area.

In another embodiment, for example, the non-return valve may be omitted—e.g. in arrangements in which it is unlikely that the container 12 will be raised above the level of the reservoir 15. Alternatively or additionally, the flexible tube 13 may include a section (intermediate its ends **13*a*,13*b***) that is resilently coiled to permit extension of the tube from its coiled retracted state as it is in use pulled to a desired remote location.

In another example (with or without one or more of the modifications mentioned in the preceding paragraph), the end **13*a* of the flexible tube 13 may be connected directly to, or may effectively replace, the inlet tube 19 of the atomiser unit 11—whereby the container 12 may be omitted. Preferably however, the container 12 may be replaced by a generally tubular body to the top of which the atomiser unit 11 is attached with its combined operating button and dispensing head 20 above the body and with its other components disposed within—and protected by—the generally tubular body. This body can be conveniently gripped by the user whilst the apparatus is being used, and preferably it has a widened zone of inverted conical shape adjacent its upper end whereby the body, when out of use, can be conveniently supported by a C-shaped support member and yet be readily removed therefrom when it is to be used. Advantageously the C-shaped support member may be formed integrally with the reservoir 15 or with the housing 35 therefor. For example, the reservoir 15 or the housing 35** may have a removable top (to permit replenishment or replacement of the reservoir) and a generally planar rear wall extension projecting laterally from the more bulbous main formation of the reservoir or housing, the C-shaped support member being formed integrally with and as a forward projection from this rear wall extension of the reservoir or housing.

In one preferred arrangement, the apparatus may be supplied with an additional head to replace—upon stem 28—the existing atomising head 20 of unit 11 and permit the latter to be used instead for dispensing fluid from the remote reservoir in non-atomised form. This would be of particular advantage for dispensing fluids such as sun tan oil, insect repellant, shampoo, liquid soap, washing-up liquid, salad oil, vinegar, and the like.

It will be appreciated that, in all the above-described embodiments and their modifications, the fluid is not pre-pressurised by any gas (i.e. it is "non-pressurised") and the force employed to dispense the fluid is solely manual.

Other modifications and embodiments of the invention will be readily apparent to those skilled in this art. All such modifications and embodiments are to be deemed within the ambit and scope of the invention, and the invention is not to be deemed limited to the particular embodiment(s) hereinbefore described which may be varied in construction and detail without departing from the scope of the patent monopoly hereby sought.

I claim:

1. Fluid dispensing apparatus comprising:

a plurality of containers for fluids to be dispensed, a plurality of atomiser units associated with said containers and for dispensing the fluids therethrough, each unit comprising an elongate hollow body having attached to one end thereof a dispensing head from which the fluid is to emanate, said dispensing head being manually depressible in a direction inwardly of the body and being resiliently restorable in a direction outwardly of said body, and said body incorporating within it a manually-operable piston-cylinder arrangement actuable directly upon the fluid to feed the fluid to said dispensing head, said piston-cylinder arrangement being manually-operable by manual depression of said dispensing head, a single reservoir for the fluid at a location remote from said containers, and a plurality of fluid paths, each including a flexible conduit, connecting the single reservoir and the piston-cylinder arrangement of the plurality of containers to provide for replenishment of said container with fluids from the single reservoir.

2. Fluid dispensing apparatus comprising:

(a) an atomiser unit for fluid to be dispensed, said unit comprising an elongate hollow body having attached to one end thereof a dispensing head from which the fluid is to emanate, said dispensing head being manually depressible in a direction inwardly of the body and being resiliently restorable in a direction outwardly of the said body, and said body incorporating within it a manually-operable piston-cylinder arrangement actuable directly upon the fluid to feed the fluid to said dispensing head, said piston-cylinder arrangement being manually-operable by manual depression of said dispensing head, (b) a non-pressurised remote reservoir for the fluid, and (c) a fluid path, including a flexible conduit, between the piston-cylinder arrangement of said atomiser unit and the remote reservoir to permit dispensing of non-gas-pressurised fluid in atomised form across a variety of locations remote from said reservoir.

3. Fluid dispensing apparatus according to claim 2, wherein the atomiser unit is associated with a container from which the fluid is to be dispensed, the container being in use supplied with fluid from the remote reservoir via said flexible conduit.

4. Fluid dispenser apparatus according to claim 3, wherein said remote reservoir has a capacity substantially greater than that of the container.

5. Fluid dispenser apparatus according to claim 3, wherein said remote reservoir has a capacity 10 to 20 times greater than that of the container.

6. Fluid dispenser apparatus according to claim 3, wherein a non-return valve is provided in the fluid path between the reservoir and the container to restrict fluid flow from the container to the reservoir.

7. Fluid dispenser apparatus according to claim 6, in which the non-return valve is located in said flexible conduit.

8. Fluid dispensing equipment comprising a plurality of separate fluid dispensing apparatuses each according to claim 2, and a housing to house the plurality of said reservoirs.

9. Fluid dispensing equipment according to claim 8, wherein each said reservoir contains a different fluid.

10. Fluid dispensing apparatus comprising:

a container for fluid to be dispensed, an atomiser unit associated with said container and for dispensing the fluid therethrough, said unit comprising an elongate hollow body having attached to one end thereof a dispensing head from which the fluid is to emanate, said dispensing head being manually depressible in a direction inwardly of the body and being resiliently restorable in a direction outwardly of said body, and said body incorporating within it a manually-operable piston-cylinder arrangement actuable directly upon the fluid to feed the fluid to said dispensing head, said piston-cylinder arrangement being manually-operable by manual depression of said dispensing head, a remote reservoir for the fluid, and a fluid path, including a flexible conduit, connecting the reservoir and the piston-cylinder arrangement of the container to provide for replenishment of said container with fluid from the reservoir.

11. Fluid dispenser apparatus according to claim 10, wherein said remote reservoir has a capacity substantially greater than that of the container.

12. Fluid dispenser apparatus according to claim 10, wherein said remote reservoir has a capacity 10 to 20 times greater than that of the container.

13. Fluid dispenser apparatus according to claim 10, wherein a non-return valve is provided in the fluid path between the reservoir and the container to restrict fluid flow from the container to the reservoir.

14. Fluid dispenser apparatus according to claim 13, in which the non-return valve is located in said flexible conduit.

15. Fluid dispensing equipment comprising a plurality of separate fluid dispensing apparatuses each according to claim 10, and a housing to house the plurality of said reservoirs.

16. Fluid dispensing equipment according to claim 15, wherein each said reservoir contains a different fluid.

* * * * *